United States Patent [19]

Suter et al.

[11] Patent Number: 4,660,399

[45] Date of Patent: Apr. 28, 1987

[54] MOBILE ROLL-FORMING MACHINE

[76] Inventors: Frank L. Suter, Rte. 1, Box 3; Donald R. Showalter, Rte. 2, Box 340, both of Harrisonburg, Va. 22801

[21] Appl. No.: 740,883

[22] Filed: Jun. 3, 1985

[51] Int. Cl.[4] ..... B21D 5/14

[52] U.S. Cl. ..... 72/181; 72/179; 72/129; 72/176

[58] Field of Search ..... 72/179–182, 72/177, 176, 234, 129

[56] References Cited

U.S. PATENT DOCUMENTS

| | | | |
|---|---|---|---|
| 1,184,947 | 5/1916 | Gossett et al. | 72/181 |
| 1,464,018 | 8/1923 | Trachte et al. | 72/179 |
| 2,248,088 | 7/1941 | Kane | 72/181 |
| 2,397,029 | 3/1946 | McLaughlin et al. | 72/160 |
| 2,827,944 | 3/1958 | Grossu | 72/181 |
| 3,319,448 | 5/1967 | Bottom | 72/176 |
| 3,529,461 | 9/1970 | Knudson | 72/181 |
| 4,285,222 | 8/1981 | Jagelid | 72/181 |
| 4,411,146 | 10/1983 | Sulasaari et al. | 72/181 |

*Primary Examiner*—Daniel C. Crane
*Attorney, Agent, or Firm*—Dennis H. Lambert

[57] ABSTRACT

A mobile roll-forming machine for shaping of metal panels used, for example, in building construction, roofing and the like. The machine may be easily transported to the construction site for on-site formation of metal panels, and supports a roll of sheet metal from which the panels are to be formed. The machine (10) comprises a main frame (11) to which a metal roll-forming head assembly (13) is removably secured, whereby different head assemblies may be quickly and easily substituted on the main frame for forming different shapes in the metal panels. The head assembly (13) may also be elevated to an inclined position relative to the main frame for matching the pitch of a surface being covered with the metal panels, whereby the panels may be fed directly from the machine onto the surface. The machine further includes a shear blade (36) for cutting the metal panels to any desired length, and slicing wheels (68) for cutting the panels to desired width.

15 Claims, 22 Drawing Figures

MOBILE ROLL-FORMING MACHINE

TECHNICAL FIELD

This invention relates to a metal forming machine for imparting desired shapes to sheet metal. More particularly, this invention relates to a roll-forming machine for producing standing seam, corrugated or other shape metal panels for use in the building industry, for example.

In the construction of metal roofs and siding, adjacent panels are placed in side-by-side relationship with adjacent edges overlapping and seamed to secure the panels together and to prevent leakage through the seam. The seams generally comprise shaped edge portions of the metal panels, bent either by hand or machine. In order to provide an attractive and leakproof surface, it is essential that the seams be accurately and uniformly formed.

BACKGROUND ART

In the prior art, the shaped edge portions or flanges of metal panels used in roofing and/or siding, for example, are most often formed by use of hand tools. This procedure is laborious, time-consuming, wasteful of material and relatively expensive. Moreover, the hand-forming process frequently results in non-uniform and uneven seams, creating an unsightly and potentially leaky surface.

In an effort to reduce or eliminate the above problems, the builder or contractor may order and purchase preformed metal panels from a supplier. This solution, however, results in a relatively expensive panel due to the necessity of paying someone else to shape the panels and because of the increased storage, shipping and handling costs. Moreover, if the number and/or size of the preformed panels is miscalculated by the builder or contractor, delays in construction and further expenses may be incurred.

Various machines have been developed for forming metal roofing and siding panels, including some portable machines which may be used for on-site shaping of the metal panels. Such machines are exemplified in U.S. Pat. Nos. 2,294,324, 2,747,642, 3,462,989, 3,595,053, 3,788,115 and 3,823,592. With the exception of U.S. Pat No. 3,823,592, all of these patents describe machines which are constructed and intended to produce metal panels having a single predetermined shape. Some of the machines may be modified to produce metal sheets having different shapes by replacing individual sets of forming rolls. U.S. Pat. No. 3,823,592 does disclose a structure wherein a spine member carrying sets of forming rolls may be detached and replaced with a spine member carrying different forming rolls to impart different shapes to the metal being formed. The drive means for the rolls remains attached to the main frame of the machine, and individual coupling devices for each driven shaft and roll are provided. Panels formed by the machines must then be lifted onto the surface (roof) being covered with the panels.

DISCLOSURE OF THE INVENTION

In accordance with the present invention, a metal forming machine is provided which may be readily transported to the job site for on-site formation of the panels. The machine of the invention has interchangeable metal-forming head assemblies which may be quickly and easily substituted to impart different shapes to the metal. Each head assembly is self-contained in that it carries the drive means for each driven roll in the assembly, and only a single coupling connection is required with the main frame and drive means. Thus, alignment problems and faulty drive connections are virtually eliminated.

Moreover, in the machine of the invention, the forming rolls may be adjusted laterally of the machine to accomodate metal of different widths, and the head assembly may be elevated to match the pitch of a roof or the like being surfaced, whereby the formed metal panels may be fed directly from the machine onto the surface.

BRIEF DESCRIPTION OF THE DRAWINGS

Details of the invention are described in connection with the accompanying drawings, wherein like reference characters designate like parts throughout the several views, and wherein.

BEST MODE FOR CARRYING OUT THE INVENTION

Figure 1:
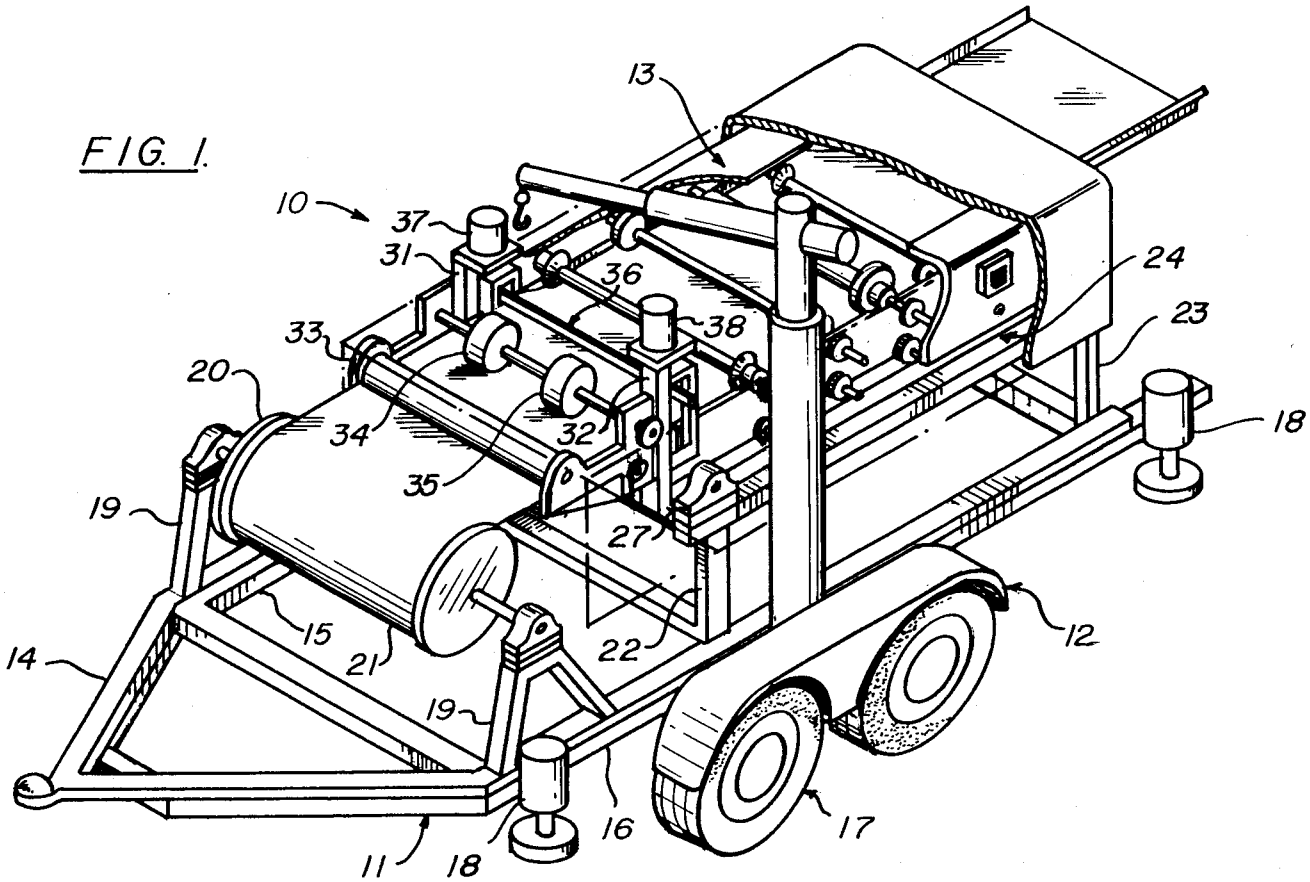
FIG. 1 is a top perspective view, with portions cut away, of a first form of machine according to the invention, in which the form rolls also serve to propel the metal through the machine and in which the machine produces panels shaped for standing seam roofs.

Referring first to FIGS. 1 through 8, a first form of mobile metal forming machine for forming standing seam panels is indicated generally at 10. The machine comprises a main frame 11, which may be formed as part of a trailer 12 or separately constructed and mounted on a trailer frame, and a roll-forming head assembly 13 detachably mounted on the main frame.

The main frame 11 includes a forwardly extending tongue portion 14 for attachment to a suitable hitch for transporting the machine, elongate longitudinally extending side frame members 15 and 16, wheel and axle assembly 17, and jack stands 18 at the four corners of the frame for leveling and supporting the machine during use. The jack stands 18 may be of suitable conventional construction and may be hydraulically or pneumatically operated or manually operated as by screw threads or the like. Moreover, the frame/trailer 11 may be provided with conventional brakes and lights, if desired. In addition, upstanding truss members 19 near the front of the trailer frame support a dereeler 20 for holding a roll of metal 21. The dereeler may be of conventional construction and is intended to accurately and securely support the roll of metal in precise alignment with the roll-forming head assembly 13. The main frame 11 also includes a plurality of upstanding posts 22 and 23 which support a main frame superstructure 24. A plurality of cross pieces 25 extend across the width of the superstructure, providing a platform on which the head assembly rests. A pair of hinges 26 and 27 are supported on top of the main frame superstructure at opposite sides of the forward end thereof, rotatably carrying a crossbar 28. A pair of rearwardly extending stub frame members 29 and 30 are secured on the cross bar 28 at its opposite ends, and a pair of upstanding frame members 31 and 32 secured to the stub frame members as by welding or the like carry a forwardly projecting infeed guide 33, a pair of drive roll sets 34 and 35, and a shear blade assembly 36 for cutting the metal into desired lengths. The shear blade assembly 36 may be operated by a pair of hydraulic cylinders 37 and 38, if desired. A hoist or crane 39 is supported on the frame 11 at one side thereof in a position to be approximately midway between the center line of the roll of metal 21 and the head assembly 13. The crane is used to place rolls of metal on the supporting trusses and is also used to lift the head assembly on and off the frame. An hydraulic motor 40 for driving the machine is supported on the superstructure 24, and a gasoline engine (not shown) is also supported on the frame 11 near the hydraulic motor 40 for driving the hydraulic motor. The motor 40 and method of driving it may be of conventional construction. Moreover, if desired, the hydraulic motor 40 and gasoline engine may be mounted outboard of the superstructure, if desired, to facilitate access thereto.

The detachable head assembly 13 comprises a pair of elongate, parallel longitudinally extending side frame members 41 and 42 aligned with the stub frame members 31 and 32, and a plurality of cross braces 43 extending between the side frame members. A pair of side frame channel members 44 and 45 are welded or otherwise suitably secured on top of the side frame members 41 and 42 and the cross braces 43, with the channel members opening toward one another. A plurality of top cross braces 46 also extend between the channel members at the tops thereof, and are welded or otherwise suitably secured beneath the top flanges of the channel members. A plurality of pairs of shafts 47, 48, 49, 50 and 51 extend across the space between the channel members and are journaled in suitable bearings 52 and 53. As seen best in FIGS. 4, 5 and 6, the bearings 52 in which the upper shafts 47*a*, 48*a*, 49*a*, 50*a* and 51*a* are journaled are vertically adjustable to adjust the spacing between the shafts in each pair. Thus, the spacing between the forming rolls carried by the shafts can be adjusted to accomodate different thicknesses of metal.

A plurality of combination forming rolls and drive rolls are fixed on the shafts in opposed pairs, and as seen best in FIGS. 3, 4, 5 and 7, include two sets of preform rolls 54 and 55 secured near the opposite ends of the first pair of shafts 47. The preform rolls 54 and 55 are substantially frusto-conically shaped and impart an upward bend of about $22\frac{1}{2}°$ in each marginal edge of a sheet of metal passing through the machine. The rolls 54 are adjustable along the shafts 47*a* and 47*b* for handling sheet metal of different widths. As seen particularly in these figures, adjustment of the rolls 54 is accomplished by means of a lockinq pin or bolt 56 extended through a short collar 54*a* into a threaded opening in the shaft. A number of openings 57 are provided for adjustment to a plurality of standard widths. Drive sprockets 58 are secured on the shafts near the right-hand ends thereof as viewed from the infeed end of the machine.

Opposed pairs of finish preform rolls 59 and 60 are fixed on the second pair of shafts 48*a* and 48*b* in alignment with the first set of form rolls for completing the bend of the marginal edge portions of the sheet of metal to 90°. As before, the left-hand pair of rolls 59 are adjustable along the shafts 48*a* and 48*b* to accommodate sheets of metal of different widths, and drive sprockets 61 are carried by the shafts between the form rolls 60 and the supporting channel member 45.

The third set or pair of shafts 49*a* and 49*b* carry a set of opposed rolls 62 at the left-hand ends thereof and a pair of opposed form rolls 63 at the right-hand ends thereof. The rolls 62 merely engage the metal and propel it through the machine. They do not perform any bending or shaping of the metal. However, the rolls 63 bend the upper edge of the flange on the right-hand side of the sheet metal downwardly to a generally horizontal position. As previously described, the rolls 62 are adjustable along the shafts, and drive sprockets 64 are carried in alignment with the sprockets 58 and 61.

The fourth pair of shafts 50*a* and 50*b* carry two pairs of opposed rolls 65 and 66 in alignment with the preceding sets of rolls, and the right-hand set of rolls 66 impart a finish bend to the flange on the right-hand side of the sheet metal. The finish bend comprises, for example, a $\frac{3}{8}$ inch wide marginal edge portion bent downwardly at an angle of about 30°. The rolls 65 function identically to the preceding rolls 62, and are adjustable along the shafts. Sprockets 67 are fixed on the shafts in alignment with the preceding sprockets.

The fifth and final pair of shafts 51*a* and 51*b* carry a pair of cutting rolls 68 for slitting the metal to a desired width. These rolls would normally be spaced away from the metal and would perform no function. However, when a narrow strip of metal is required, the rolls 68 would be brought into contact with the sheet of metal, slicing it longitudinally into a desired width. These rolls would be adjustable along the length of the shafts to cut different widths of metal. Drive sprockets 69 are also fixed on these shafts.

Figure 4:
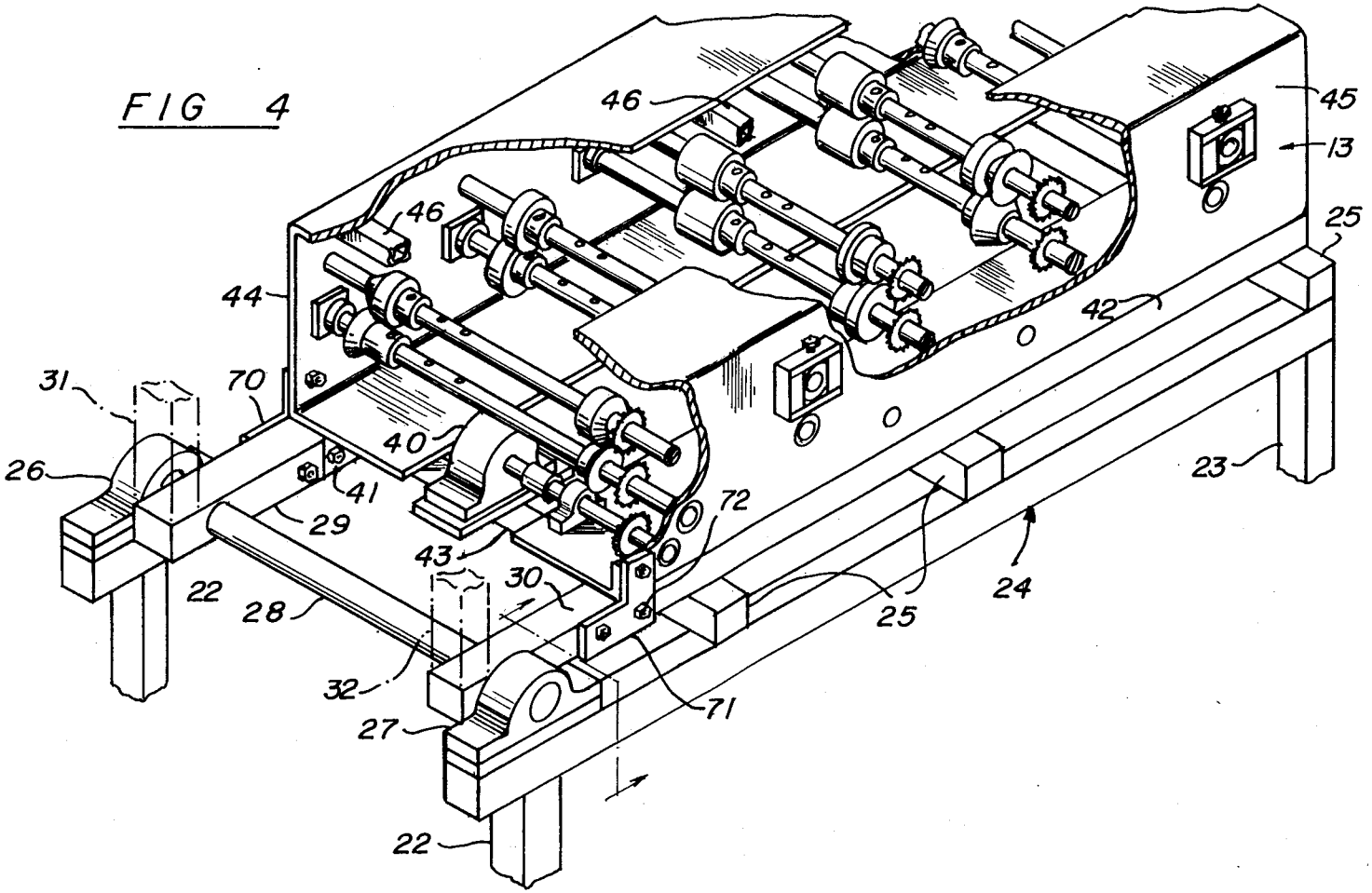
FIG. 4 is a fragmentary, top perspective view of a head assembly, with portions cut away, and a portion of the main frame shown in dot-and-dash lines.
Figure 5:
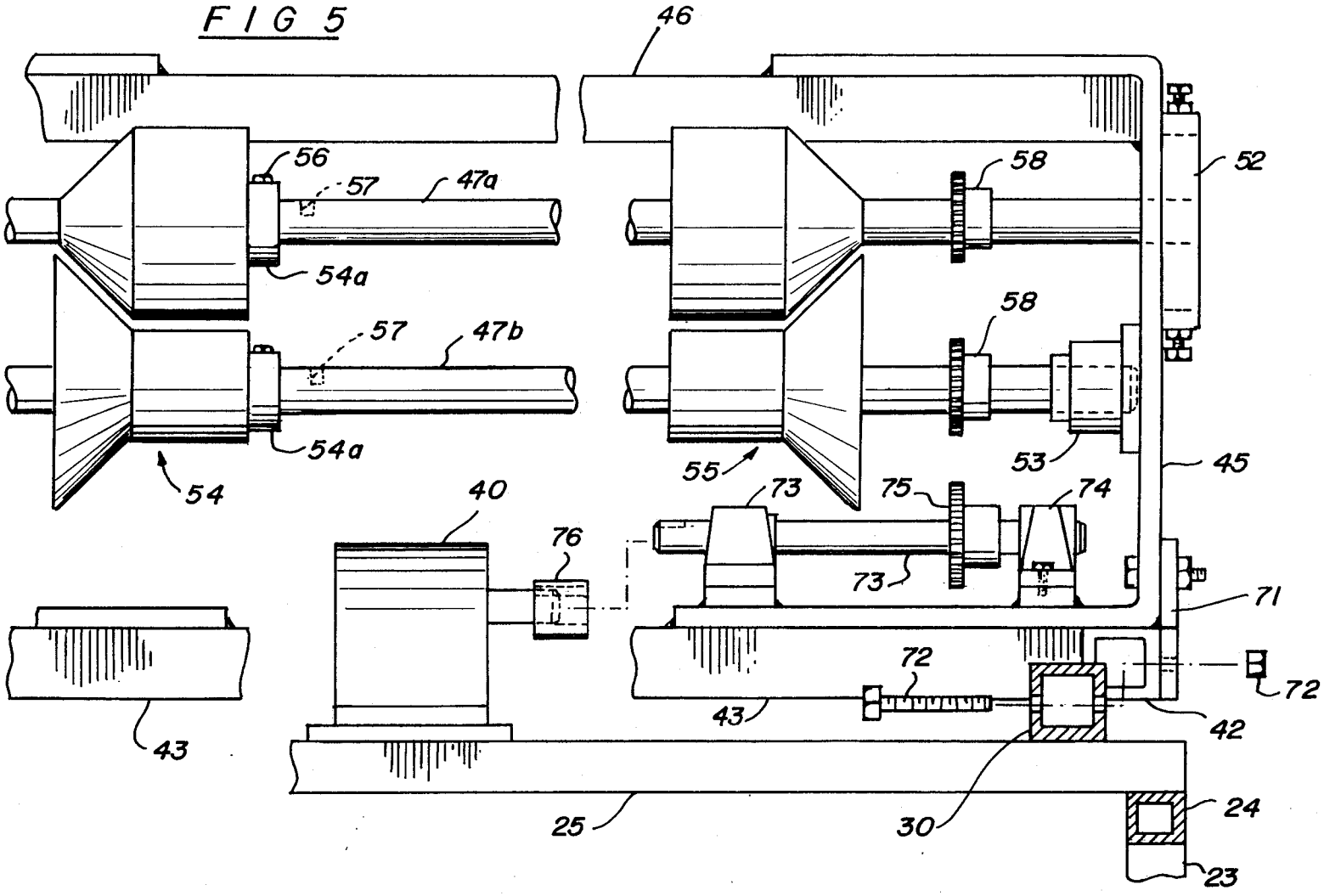
FIG. 5 is a greatly enlarged, fragmentary sectional view, with portions broken away, looking in the direction of the arrow 5—5 in FIG. 4.
Figure 6:
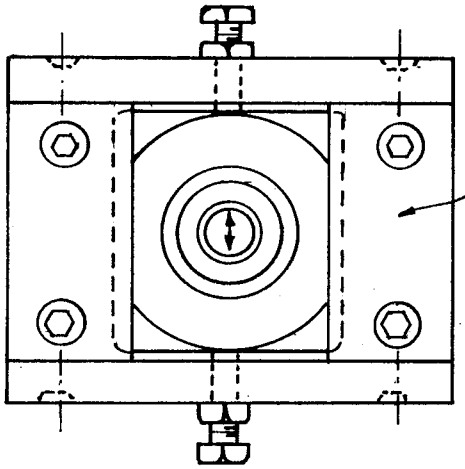
FIG. 6 is an end view of one of the bearing assemblies supporting the upper sets of shafts and form/drive rolls for vertical adjustment.
Figure 7:
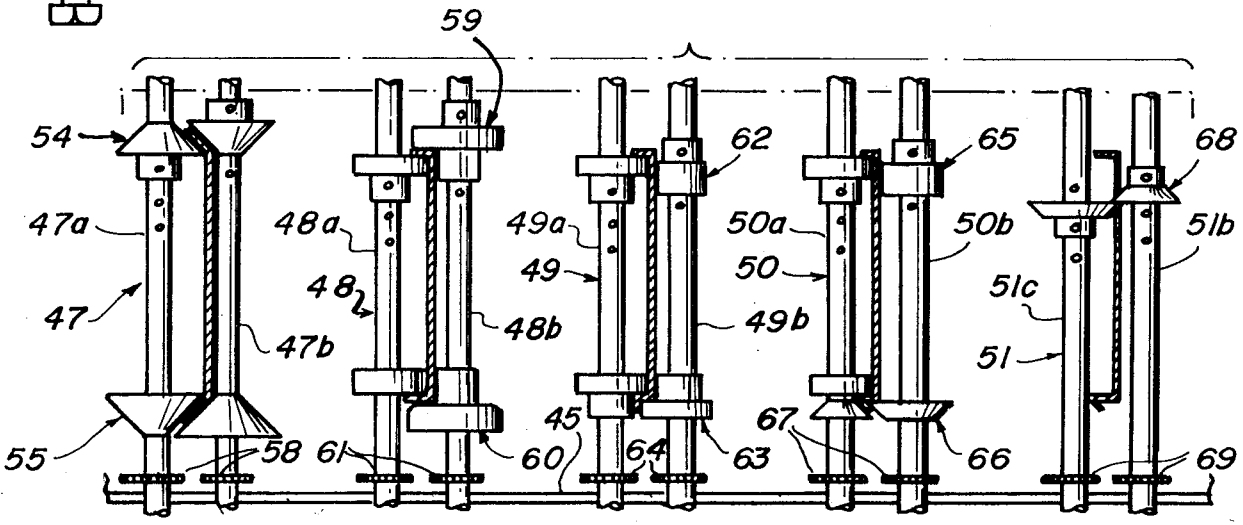
FIG. 7 is a top schematic view showing the various steps in formation of the flanges at the edges of the standing seam panels.

As seen best in FIGS. 4 and 5, the roll forming head assembly 13 is removably connected to the main frame superstructure by means of a pair of mounting brackets 70 and 71 and a plurality of bolts 72 extended through the brackets and the adjacent stub frames 29 and 30 and the side frame members 41 and 42, securing these parts together. In addition, a drive shaft 73 is rotatably supported on the bottom horizontal flange of the channel frame member 45 by means of a pair of spaced bearings 73 and 74. A drive sprocket 75 is fixed on the drive shaft between the bearings in alignment with the sprockets carried by the shafts 47–51. The drive shaft is coupled with the hydraulic motor 40 via a direct sleeve coupling 76, but any suitable type of power take-off may be used. Thus, when it is desired to remove the forming roll head assembly, the bolts 72 are removed and the head assembly moved sideways a slight distance to disengage the slip coupling, after which the head assembly may be simply lifted away from the main frame superstructure. The reverse procedure is used to reassemble the head assembly to the main frame.

Figure 2:
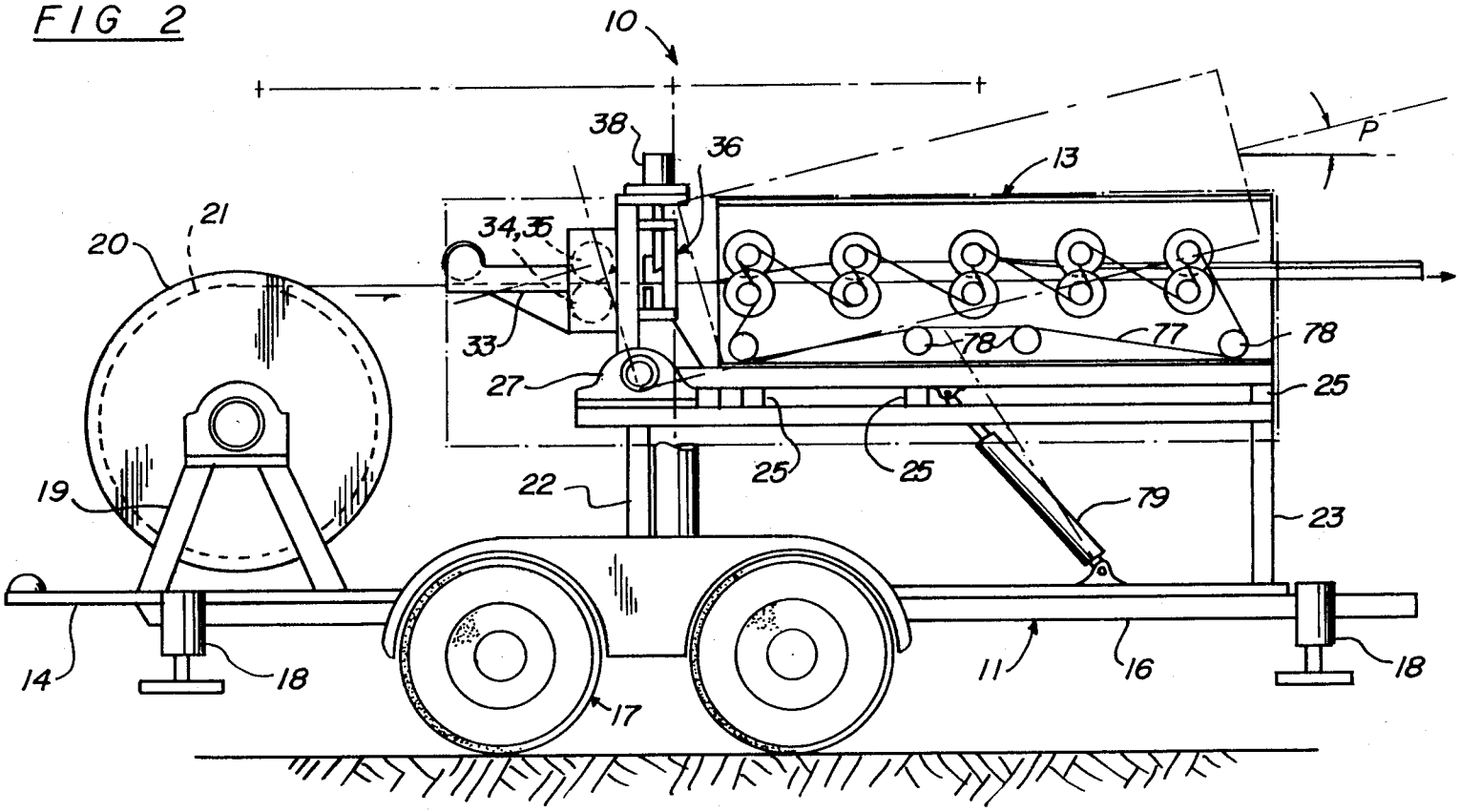
FIG. 2 is a somewhat schematic side view in elevation, with the protective cover shown in dot-and-dash lines, of the machine of FIG. 1.
Figure 3:
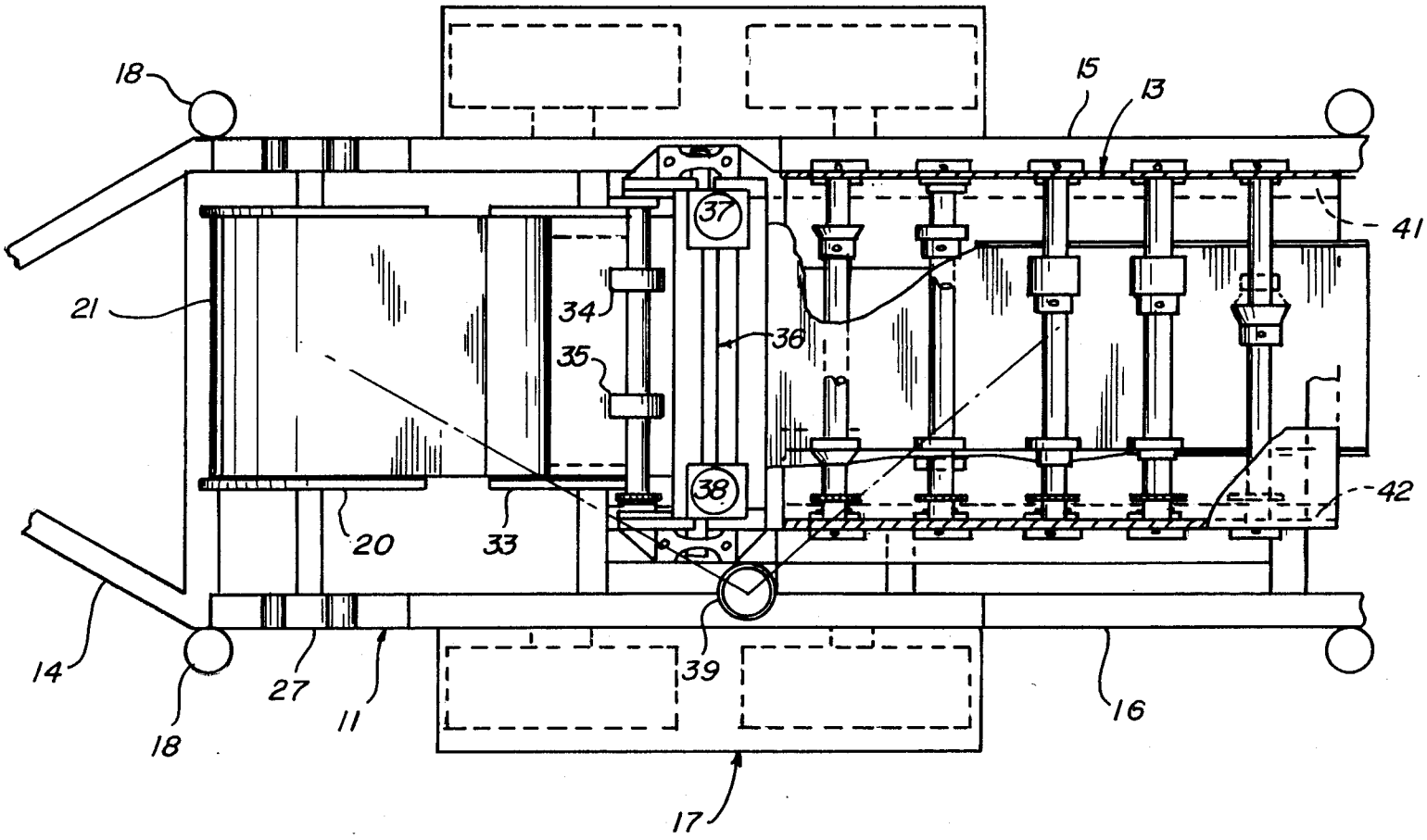
FIG. 3 is a top plan view, with portions cut away, of the machine of FIG. 1.

As seen in FIGS. 2 and 4, the drive chain 77 engages the sprockets in a manner to drive the shafts and form rolls in the appropriate direction. A plurality of idler sprockets 78 are provided to support the drive chain.

With the arrangement as described, it is very simple to connect and disconnect the head assembly from the main frame, and there are no required adjustments to the shafts, drive sprockets or form rolls. In other words, alignment of all of the metal forming components of the machine remains intact and is not affected by removal of the head assembly. Consequently, the head assembly may be removed and a different head assembly substituted in only a few minutes by unskilled labor.

Figure 8:
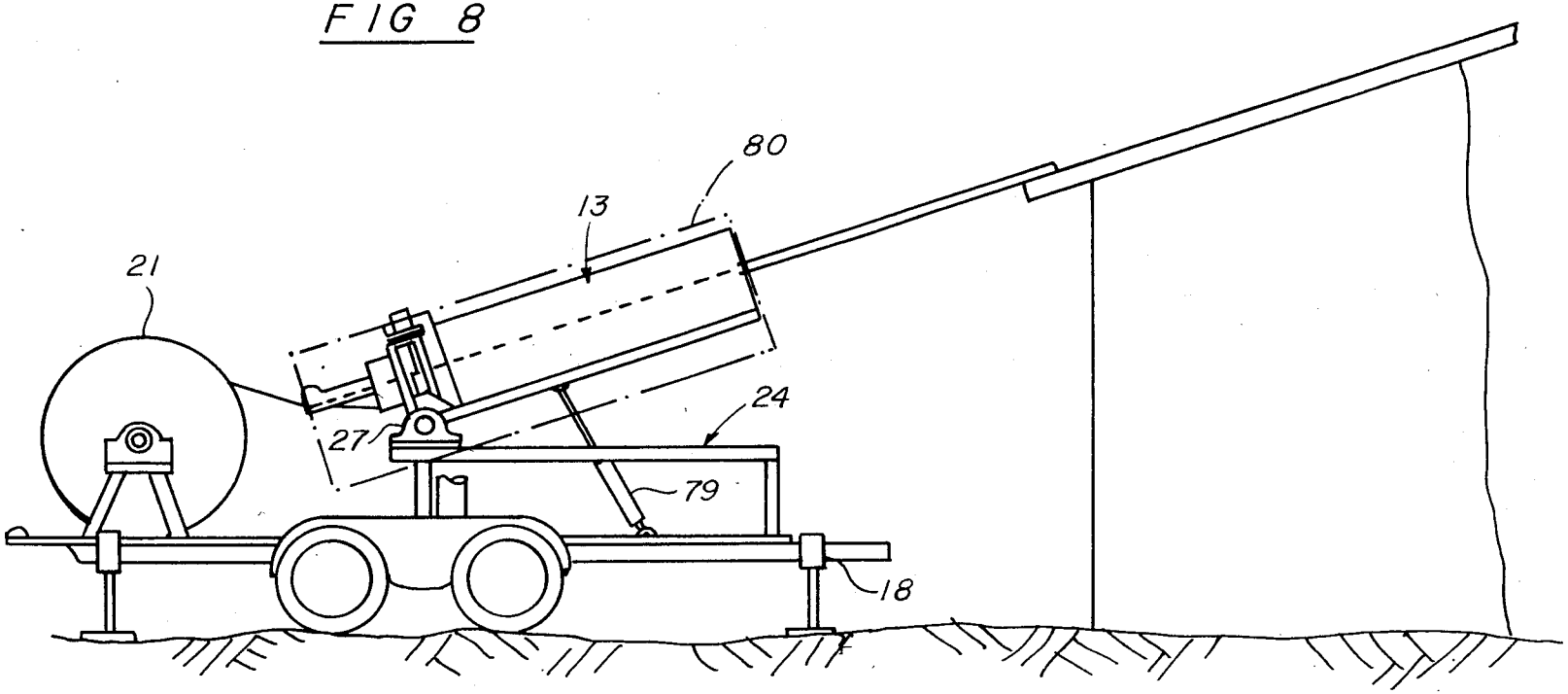
FIG. 8 is a somewhat schematic side view of the machine of FIG. 1, showing the head assembly in an elevated position to match the pitch of a roof being surfaced with metal formed by the machine.
Figure 9:
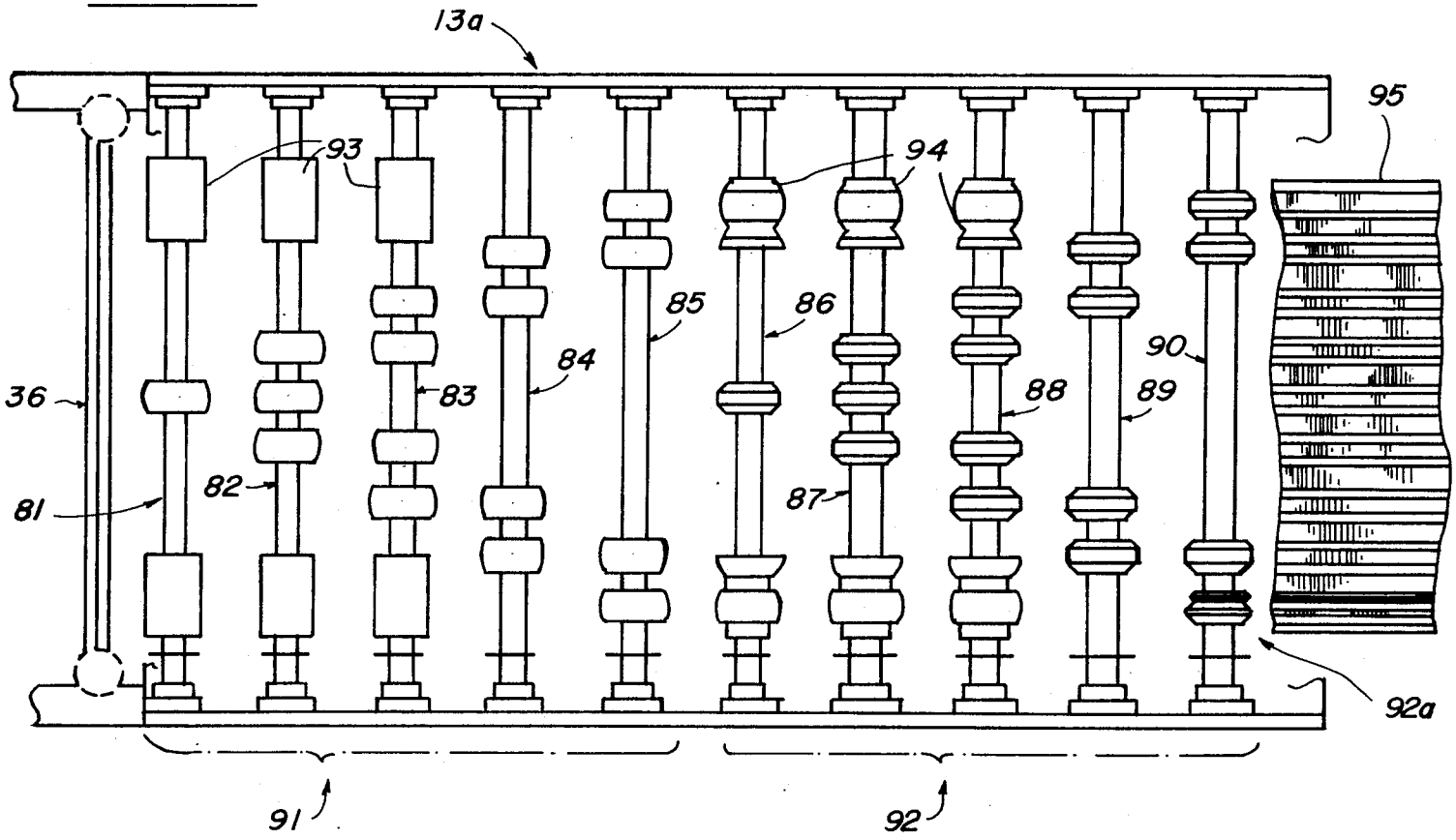
FIG. 9 is a schematic top plan view of a modified head assembly in which sets of drive rolls and form rolls are constructed and arranged to form sheets of corrugated metal.
Figure 10:
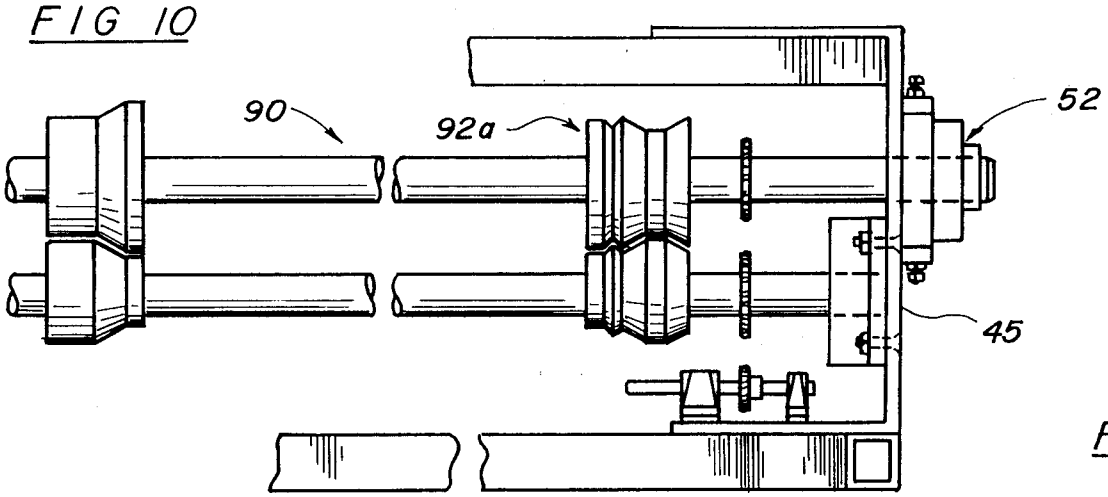
FIG. 10 is a view similar to FIG. 5, with the drive motor and coupling means removed, showing the relationship of the final set of forming rolls used in the head assembly of the modification of FIG. 9.
Figure 11:
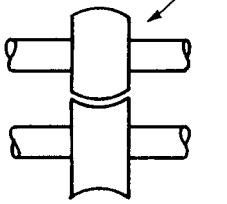
FIG. 11 is a schematic view of the relationship of a set of form rolls as used in the initial, pre-form stage in the corrugated head assembly of FIG. 9.
Figure 12:
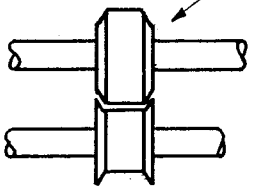
FIG. 12 is a view similar to FIG. 11 but showing a final form roll set from the corrugated head assembly of FIG. 9.

As shown in FIGS. 2 and 8, the head assembly 13 may be tilted or inclined upwardly about the pivot axis of the hinges 26 and 27 in order to match the angle of discharge of metal from the machine with the pitch of a roof or other surface being covered. Thus, the formed metal may be discharged directly onto the roof, reducing the amount of manual effort required in placing the metal on the roof. A hydraulic ram 79 is engaged between the main frame and head assembly for elevating the head assembly when desired.

Further, in order to reduce the possibility of injury to workmen using the machine and also to protect the working components of the machine from the elements, a suitable cover 80 formed of metal or plastic or the like may be secured over the head assembly. This cover is readily removable for substitution of different head assemblies. In addition, a pan or shield (not shown) may be provided beneath the head assembly to protect the head assembly from dirt, water and the like during use and transport of the machine.

A first modification of the invention is illustrated in FIGS. 9 through 12. In this form of the invention, the head assembly 13*a* comprises a corrugating head for forming corrugated metal. This head is somewhat longer than the head 13 previously described and instead of the forming rolls as previously described, has a plurality of pairs of shafts 81–90, to which are secured opposed pairs of preform forming rolls 91 and opposed pairs of finish forming rolls 92. In the example illustrated and described, drive rolls 93 and 94 are carried by at least some of the shafts to assist in propelling the metal through the machine. The drive rolls 94 are shaped to correspond to the shape of the metal passing therebetween from the preform forming rolls 91. A pair of slitting rolls (not shown) may also be provided to cut the finished corrugated sheet to desired width. In all other respects, this form of the machine is identical to that previously described and illustrated.

Figure 13:
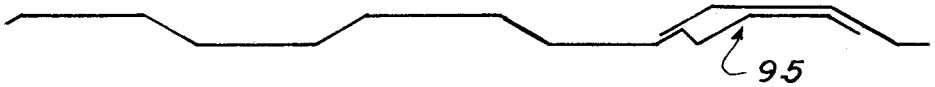
FIG. 13 is a schematic end view of adjacent edge portions of a pair of corrugated panels formed with the machine of the invention, illustrating the anti-siphon channel.

With respect to the arrangement of forming rolls in the corrugating head 13*a*, it should be noted that the rolls are arranged in groupings spaced equidistantly on opposite sides of the centerline of the machine, with the first forming rolls to engage the metal passing through the machine being disposed nearer the center line, and subsequent forming rolls being spaced farther toward the edge of the metal being formed. This enables the metal to "pull" inwardly as it is being formed and avoids tearing of the metal. In other words, succeeding forming rolls are disposed in a "V" configuration. Moreover, the corrugations are formed in successive steps, with the preform rolls 91 imparting a curved configuration to the metal, and the finish rolls 92 completing the forming of the metal to the rectilinear configuration shown at the right-hand side of FIG. 9 and also in FIG. 13. It should be further noted that the rearmost right-hand forming roll 92*a* is shaped to form a modified channel configuration in the metal. This modified channel configuration 95 is designed to prevent siphoning of water between the overlapped edges of adjacent panels of corrugated metal (see FIG. 13).

Figure 19:
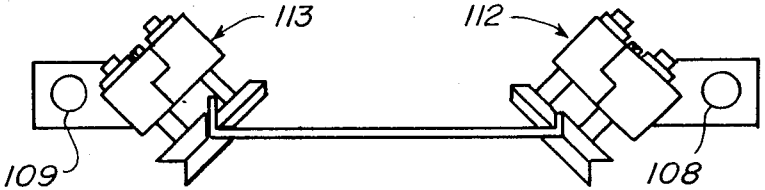
Figure 20:
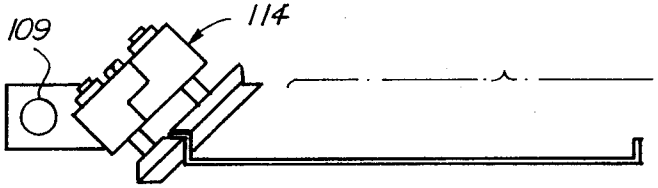
Figure 21:
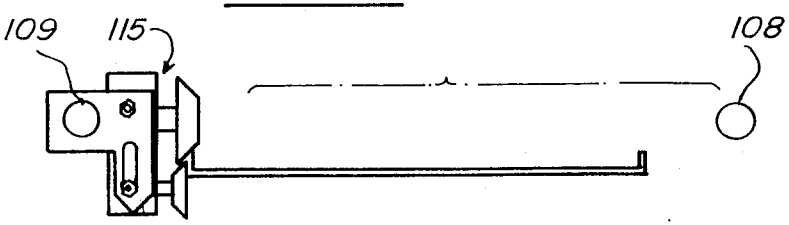
Figure 22:
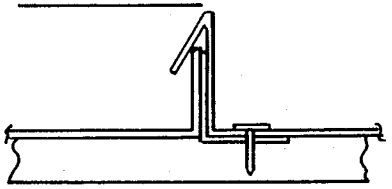
FIG. 22 is an enlarged, transverse sectional view of a standing seam formed by the overlapped adjacent edges of two panels shaped with the machine of the invention.

A second modification of the head assembly is shown at 13*b* in FIGS. 14 through 21. In this form of the invention, the forming rolls are free-wheeling and the metal is propelled through the machine by a separate set of drive rolls. The head assembly 13*b* comprises a pair of spaced apart, elongate, parallel side frame members 96 and 97 with a pair of generally trapezoidally shaped frame "loops" 98 and 99 carried thereby near the opposite ends thereof. The frame loops each comprise relatively short upstanding posts 100 and 101 welded on top of the side frame members 96 and 97, inwardly inclined portions 102 and 103, and telescopically interengaged horizontally extending portions 104 and 105. In addition, a horizontally extending cross-piece 106 extends between the upstanding posts 100 and 101. The cross-pieces 106 are slidable in the posts 100 and may be secured in adjusted position by a bolt 107 extended through the side of the post 100 and into contact with the cross-piece. A pair of longitudinally extending bars 108 and 109 extend through the upper ends of the posts 100 and 101, each carrying a first set of adjustable forming rolls 110 and 111, respectively, for imparting a preform bend to the marginal edges of the sheet metal passing through the machine, as shown schematically in FIG. 18. A second set of substantially identical forming rolls 112 and 113 are carried by the bars 108 and 109, respectively, for completing the preform bend to 90° at the edges of the metal as shown in FIG. 19. A third set of forming rolls 114 are carried by only the bar 109 and are configured to bend the top edge of one of the flanges on the sheet metal over approximately 90° as shown in FIG. 20. A fourth set of forming rolls 115 are also carried by only the bar 109 to complete the bend of the edge of said flange as shown in FIG. 21.

The forming rolls are all free-wheeling and are supported in bearing blocks so that one wheel of each pair is adjustable relative to the other wheel. By loosening the bolt 107, the bar 108 and associated frame portions 100, 102 and 104, along with the bar 108 and associated form rolls, may be moved laterally toward the opposite frame portions and form rolls, whereby sheets of metal of different widths may be formed.

The metal is propelled through the machine by a plurality of drive roll sets 116, 117 and 118 carried on spaced, parallel drive shafts 119*a* and 119*b*, 120*a* and 120*b*, and 121*a* and 121*b*. The drive shafts are journaled at their opposite ends in suitable bearings carried by opposed channel members 122 and 123 above the plane of the metal being formed and opposed channel members 124 and 125 below the plane of the metal. A suitable drive chain (not shown) is engaged with drive sprockets 126 and 127 fixed on the drive shafts. The drive sprockets are connected to be driven by the motor 40 via a slip coupling just as in the previously described forms of the invention.

Figure 14:
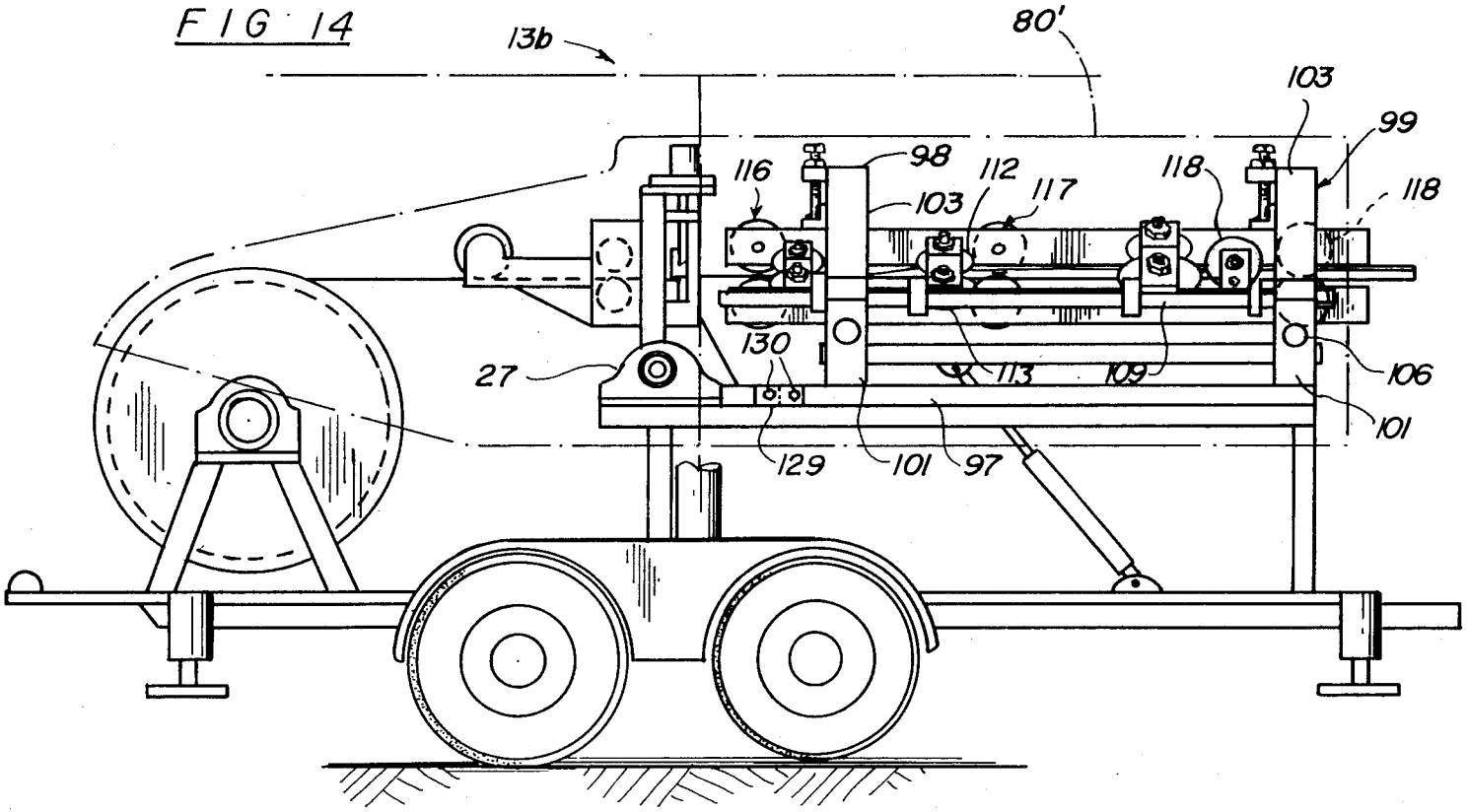
FIG. 14 is a view similar to FIG. 2 of a second modification of the head assembly, in which separate drive rolls and form rolls are used to form a standing seam panel.
Figure 15:
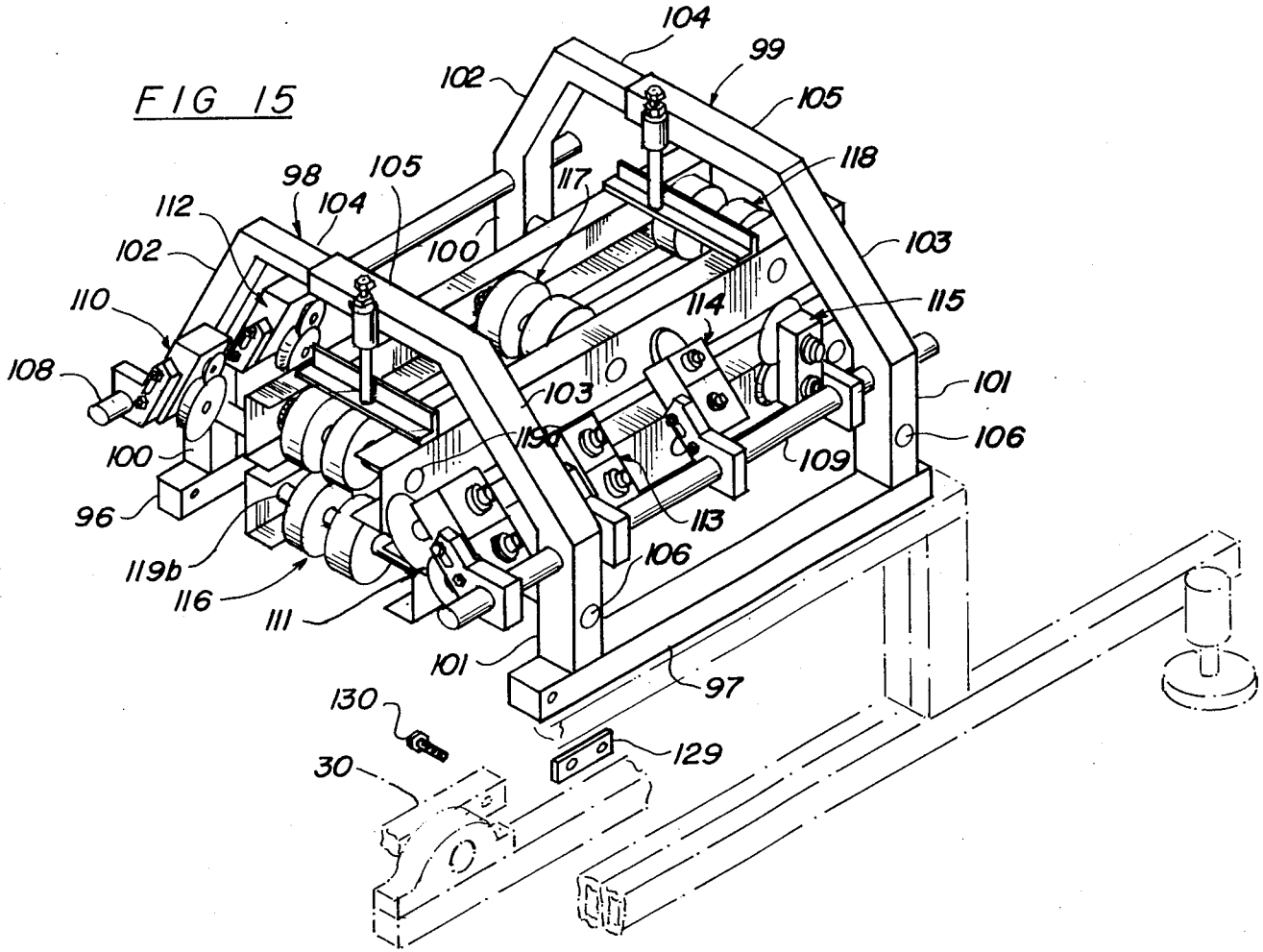
FIG. 15 is a view similar to FIG. 4 of the modified head assembly of FIG. 14.
Figure 17:
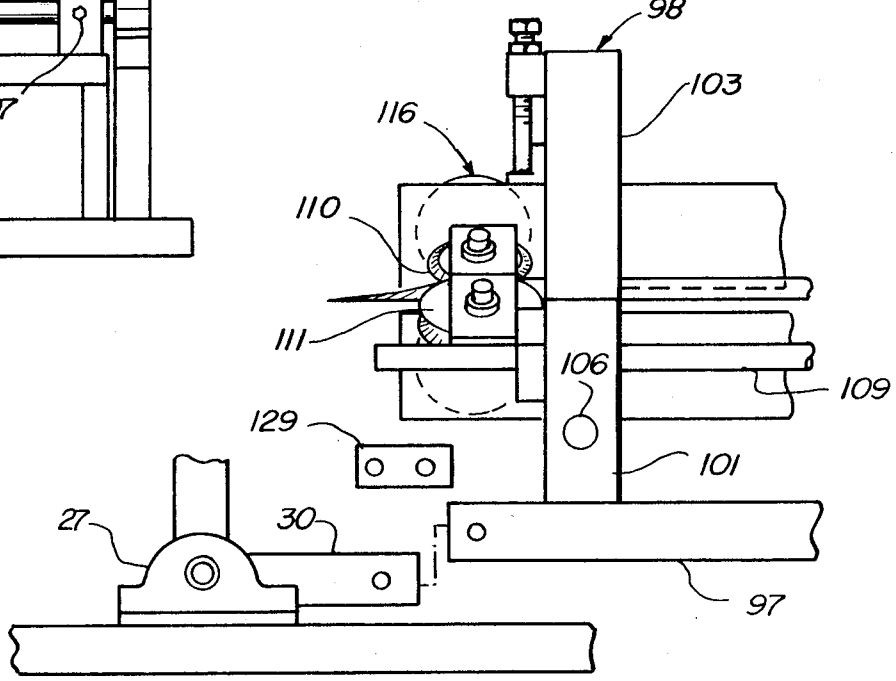
FIG. 17 is a greatly enlarged, fragmentary side view of a portion of the head assembly and main frame of the machine of FIG. 14, illustrating the detachable connection between the head assembly and main frame.
Figure 16:
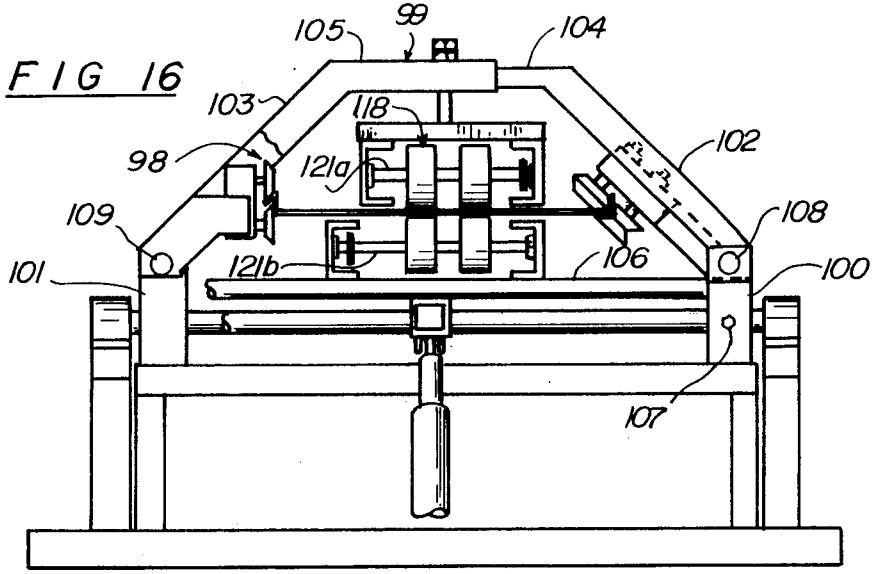
FIG. 16 is a somewhat schematic end view, with portions broken away, of the head assembly of FIG. 14, looking from the exit end of the machine.
Figure 18:
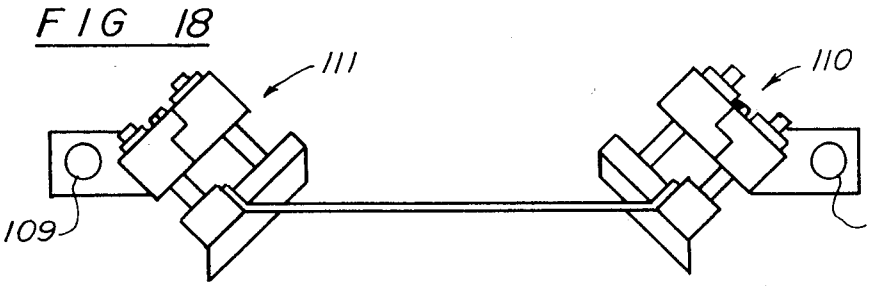
FIGS. 18 through 21 are schematic views showing the various stages in the formation of the standing seam flanges at the edges of the metal panel using the machine of FIG. 14.

As shown in FIGS. 14 and 17, the head assembly is removably connected with the main frame via a pair of brackets 128 and 129 and bolts 130 extended therethrough and through the stub frame members 29 and 30 and the side frame members 96 and 97.

A modified cover 80′ is removably secured over the head assembly 13*b*. In all other respects, the rest of the machine is identical to that previously described.

We claim:

1. A roll-forming machine for shaping metal, comprising:

a main frame having an inlet end and a discharge end and including a pair of side frame members extending longitudinally therebetween;

dereeler means supported on the inlet end of the main frame for supporting a roll of sheet metal on the main frame;

pivot means supported on said main frame near the dereeler;

infeed guide means attached to the pivot means for pivoting movement relative to the main frame about a pivot axis extending parallel to a plane of the main frame established by the side frame members and transverse to the longitudinal axis thereof, for receiving and guiding a sheet of metal supplied from the dereeler;

a detachable, pivoted head assembly for shaping metal supplied from the dereeler and having an inlet end and a discharge end and removably attached at its inlet end to the pivot means for pivoting movement about said pivot axis from a generally horizontal position parallel to and resting on the main frame to an elevated position with its discharge end spaced above the main frame for discharging shaped metal from the head assembly in a plane matching the angle of elevation of the head assembly, said head assembly and infeed guide means being connected for pivotal movement together, said head assembly discharge end located at said main frame discharge end, and there being only one head assembly mounted on said main frame through said pivot means;

a plurality of metal shaping roller couples carried as a unit by said head assembly and being spaced and configured to impart a predetermined configuration to a sheet of metal supplied thereto from the dereeler and infeed guide means;

drive means carried by said head assembly for feeding a sheet of metal through the head assembly to shape the metal;

power means carried by the main frame and connected through a quick-disconnect power take-off means with the drive means on the head assembly; and quick-disconnect coupling means engaged between the inlet end of the head assembly and the pivot means for detaching the head assembly from the main frame and substituting a different head assembly therefor, said quick-disconnect coupling means and quick-disconnect power take-off means enabling different head assemblies to be quickly and easily substituted on the main frame without the necessity of aligning multiple drive means, metal shaping rollers and the like, whereby the roll-forming machine may be quickly and easily modified to impart selected different shapes to metal formed thereby.

2. A roll-forming machine as claimed in claim 1, wherein:

wheel means are on said main frame for making the metal forming machine portable.

3. A roll-forming machine as claimed in claim 2, wherein:

shear means is carried by said pivot means between said infeed guide means and said head assembly for cutting the metal to a desired length.

4. A roll-forming machine as claimed in claim 3, wherein:

a slitter is positioned at the discharge end of the head assembly for effecting a cut longitudinally of the metal shaped by said head assembly to trim an edge from the sheet of shaped metal, said slitter being selectively movable into and out of engagement with said sheet of metal for trimming an edge, or not, as desired.

5. A roll-forming machine as claimed in claim 4, wherein:

a hoist is carried by the main frame and has means for attachment to a roll of metal to lift the metal onto and off of the dereeler, and for lifting different head assemblies onto and off of the main frame.

6. A roll-forming machine as claimed in claim 5, wherein:

a protective shroud is mounted over at least the infeed guide means, shear means and head assembly of the metal forming machine to protect them from the elements and to prevent accidental injury from inadvertent insertion of hands and the like into the machine.

7. A roll-forming machine as claimed in claim 6, wherein:

levelling jacks are positioned at the corners of the main frame for levelling it.

8. A roll-forming machine as claimed in claim 7, wherein:

the main frame comprises a trailer frame, and includes a tongue assembly for attachment to a towing vehicle.

9. A roll-forming machine as claimed in claim 1, wherein:

the head assembly is constructed for forming standing seam flanges along opposite edges of metal shaped therein, whereby panels or sheets of metal shaped in the head assembly are intended for use in standing seam roof construction.

10. A roll-forming machine as claimed in claim 9, wherein:

the head assembly is elevatable to an angle of adjustment to match the pitch of a roof being surfaced with metal shaped therein, and is positionable with its discharge end oriented to discharge shaped metal directly onto a roof structure.

11. A roll-forming machine as claimed in claim 1, wherein:

the metal shaping rollers are connected with said drive means and serve to both shape the metal and propel it through the machine.

12. A roll-forming machine as claimed in claim 1, wherein:

the metal shaping rollers are free-wheeling, and the drive means includes separate drive rollers for engaging the metal and propelling it through the machine.

13. A roll-forming machine as claimed in claim 11, wherein:

the metal shaping rollers are spaced and configured to impart a corrugated shape to metal shaped thereby.

14. A roll-forming machine as claimed in claim 12, wherein:

the width of the head assembly, and thus the lateral spacing between the metal shaping rollers at opposite sides of the machine, is adjustable to accomodate sheets of metal of different widths.

15. A roll-forming machine as claimed in claim 1, wherein:

the lateral spacing between the metal shaping rollers at the opposite sides of the head assembly is adjustable to accomodate sheets of metal of different widths.

* * * * *